United States Patent [19]

Morton

[11] 4,214,295

[45] Jul. 22, 1980

[54] PORTABLE ELECTRIC LAMP ADJUSTABLE FROM SPOT BEAM TO DIFFUSED BEAM

[75] Inventor: Harold Morton, Audenshaw, England

[73] Assignee: Oldham Batteries Limited, Manchester, England

[21] Appl. No.: 883,424

[22] Filed: Mar. 3, 1978

Related U.S. Application Data

[63] Continuation-in-part of Ser. No. 744,850, Nov. 24, 1976, abandoned.

[30] Foreign Application Priority Data

Dec. 22, 1975 [GB] United Kingdom ..... 52384/77

[51] Int. Cl.[2] ..... F21L 23/00

[52] U.S. Cl. ..... 362/164; 362/109; 362/166; 362/240; 362/277

[58] Field of Search ..... 362/109, 164, 166, 167, 362/187, 280, 319, 277

[56] References Cited

U.S. PATENT DOCUMENTS

| | | | |
|---|---|---|---|
| 1,335,727 | 4/1920 | Eisele | 362/277 |
| 1,551,901 | 9/1925 | Nase | 362/280 |
| 2,947,854 | 8/1960 | Lozeau | 362/213 |

*Primary Examiner*—Benjamin R. Padgett
*Assistant Examiner*—J. L. Barr
*Attorney, Agent, or Firm*—Sughrue, Rothwell, Mion, Zinn and Macpeak

[57] ABSTRACT

A portable electric lamp including a body 1 mounting a lens 2, a lens holder 3, a reflector 5, and a bulb holder 6 is provided with a translucent diffuser sleeve 7 which has slots 8 which extend lengthwise thereof. The diffuser sleeve is coaxial with and surrounds the bulb holder and is associated with drive means 10–13 operable to effect axial movement of the diffuser sleeve relative to the bulb holder between a retracted position at which a bulb held in the bulb holder is arranged to direct a spot beam through the lens and a forward position at which light from the bulb is diffused by passage through the diffuser sleeve.

6 Claims, 3 Drawing Figures

PORTABLE ELECTRIC LAMP ADJUSTABLE FROM SPOT BEAM TO DIFFUSED BEAM

This is a Continuation-In-Part of application Ser. No. 744,850 filed Nov. 24, 1976 now abandoned.

BACKGROUND OF THE INVENTION

This invention relates to a portable electric lamp which is capable of directing a beam of light on to a spot or of providing a diffused beam.

The provision of a spot light is advantageous when it is desired to direct the light onto a small area, for example on to a distant piece of machinery, and the diffused beam is useful for providing lighting for a person walking in the dark. Such a lamp is particularly useful in mines as it is capable of providing a miner with a beam of light when he is observing distant objects such as the head on a coal-cutting machine and with a full spread of light for close work and walking. In such circumstances the lamp is conveniently constructed as a miner's cap lamp. It may, however, be constructed as a handlamp for mining and other uses.

SUMMARY OF THE INVENTION

According to the invention a portable electric lamp comprises a body including a lens, a lens holder, a reflector, and a bulb holder connectable through switching means with a source of electric power, wherein a translucent diffuser sleeve is co-axial with and surrounds the bulb holder and is associated with drive means operable to effect axial movement of the diffuser sleeve relative to the bulb holder between a retracted position at which a bulb held in the bulb holder is arranged to direct a spot beam through the lens and a forward position at which light from the bulb is diffused by passage through said diffuser sleeve.

The drive means may comprise a toothed rack formed on the side of the diffuser sleeve and a manually rotatable spindle which extends through a side of the body and is provided with teeth meshing with the toothed rack.

The switch means may comprise a first contact element located in the body for connection with a source of electric power and effecting electrical contact with the periphery of the spindle, a second contact element located in the body for connection with a source of electric power through the bulb holder, and a wiper rotatable with the spindle into and out of electrical contact with the second contact element.

In a preferred embodiment of the invention the diffuser sleeve has slots which extend lengthwise thereof, and the reflector is provided with a matt pattern in the regions thereof impinged upon by light passing through said slots in the light diffusing position of the diffuser sleeve.

DETAILED DESCRIPTION OF THE PREFERRED EMBODIMENTS

Figure 1:
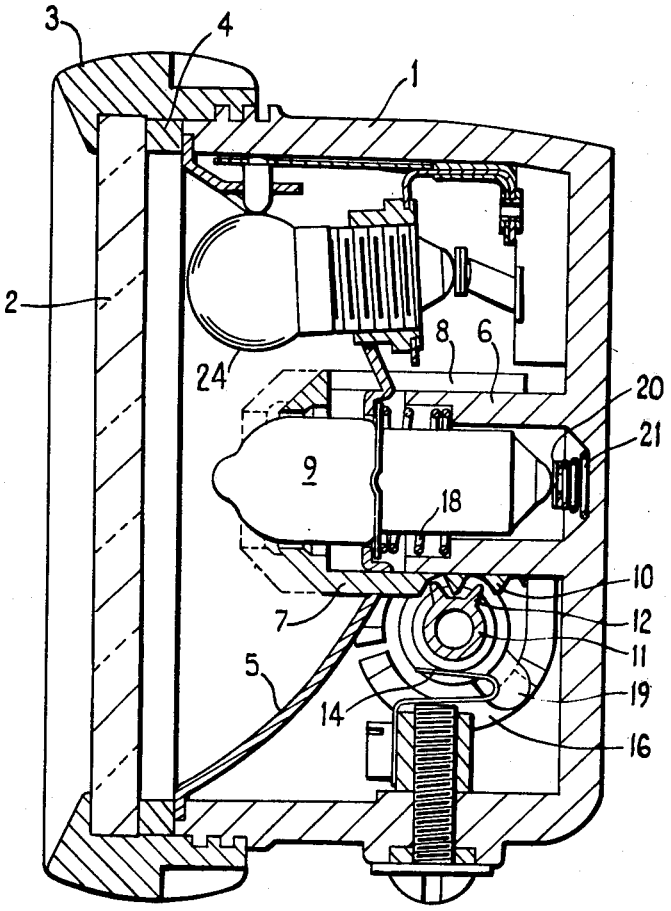
FIG. 1 is a section through a miner's cap lamp constructed in accordance with the invention, taken on line I—I, FIG. 2.

Referring to the drawings the lamp comprises a body 1, and lens 2 held in position by a lens holder 3 and a washer 4, a reflector 5, and a bulb holder 6, connectable, as described below, through switching means with a battery, not shown.

Figure 3:
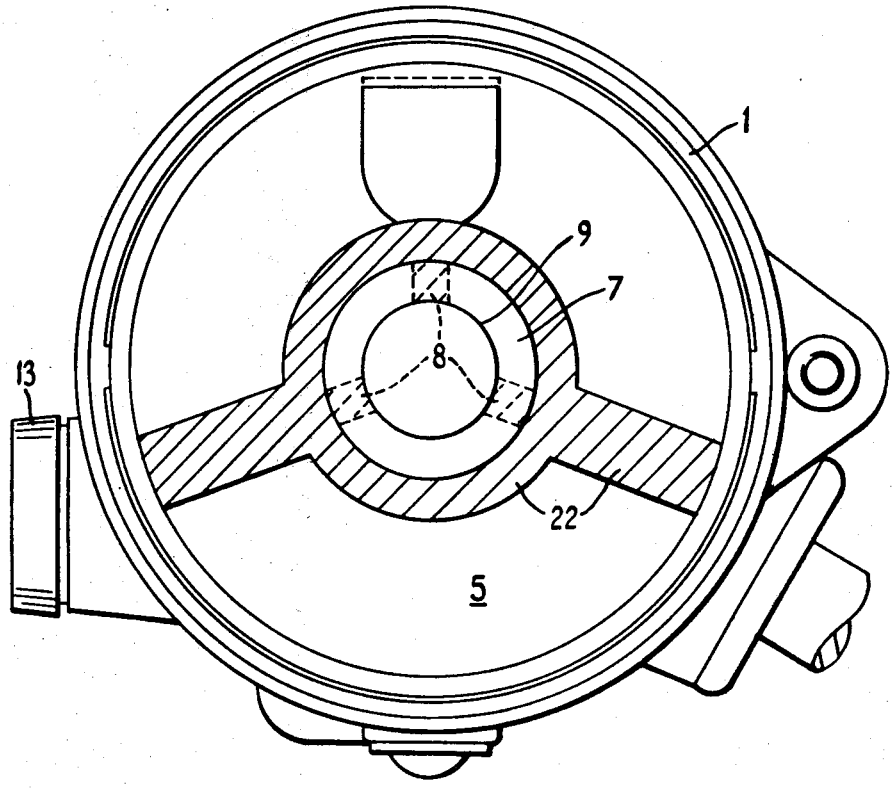
FIG. 3 is a front elevation of the lamp with the lens holder, the lens, and the washer omitted.

A translucent diffuser sleeve 7 is provided with slots 8, three such slots being shown in FIG. 3. The slots 8 extend lengthwise of the sleeve 7 which is co-axial with and surrounds the bulb holder 6. The sleeve 7 is associated with drive means operable to effect axial movement of the diffuser sleeve 7 relative to the bulb holder 6 from a retracted position, not shown, at which a bulb 9 held in the bulb holder 6 is arranged to direct a spot beam through the lens 2 to a forward position, shown in broken lines in FIG. 1, at which light from the bulb 9 is diffused. The position of the sleeve shown in full lines in FIG. 1 is a position intermediate the retarded and forward positions thereof.

Figure 2:
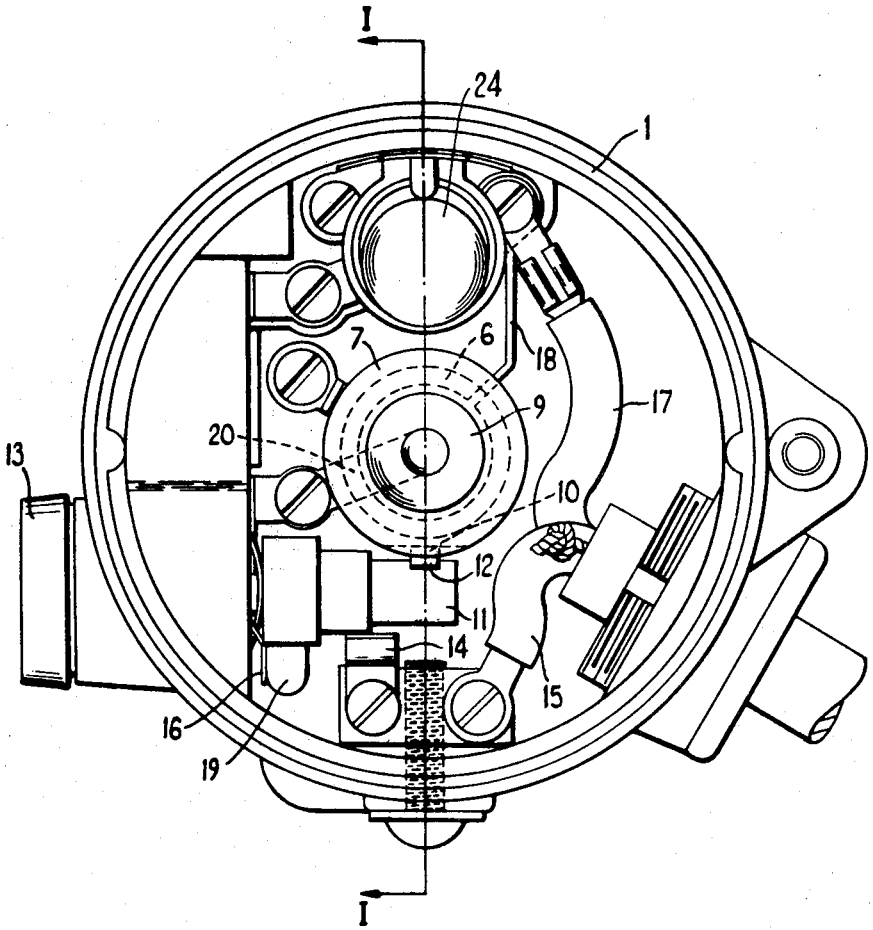
FIG. 2 is a front elevation of the lamp with the lens holder, the lens, a washer, and the reflector omitted.

The drive means comprises a toothed rack 10 formed on the side of the diffuser sleeve 7 and a manually rotatable spindle 11 which extends through the side of the body 1 and is provided with teeth 12 meshing with the toothed rack 10 and with a knob 13, FIGS. 2 and 3.

The switch means comprises a first contact element 14 located in the body 1 for connection by a lead 15 with the battery, the element 14 being a leaf spring which effects electrical contact with the periphery of the spindle 11 as shown in FIG. 2, a second contact element 16 also located in the housing 1 for connection by a lead 17 with the battery through a spring 18 in the bulb holder 6, and a wiper 19 rotatable with the spindle 11 into and out of electrical contact with the second contact element 16. The second contact element has a contact portion 20 which is urged into electrical contact with the bulb 9 by a spring 21, FIG. 1.

The lamp described above provides a diffused beam of the light when the diffuser sleeve 7 is in its forward position. The bulb 9 throws out light evenly in all directions. Therefore, light will be obtained directly from the front end of the bulb 9 which is not surrounded by the sleeve 7. The rest of the light from the bulb 9 will pass through the diffuser sleeve 7 where it is broken up and scattered in all directions. This light impinges upon the reflector 5 and is reflected by the reflector 5 in all directions. The light reflected from the reflector 5 passes through the lens 2 and mingles with the light obtained directly from the bulb 9 to provide a diffused beam of light. The diffused light obtained from the lamp is equal in intensity to the light given out by the bulb 9 itself but is spread by the diffuser sleeve 7 and the reflector 5 over a large area.

The slots 8 in the diffuser sleeve 7, which enable the sleeve to be moved axially, allow light from the bulb to impinge directly onto the surface of the reflector 5 and cause bright lines and spots in the otherwise even spread of light from the lamp. This is overcome by providing the reflector with a matt pattern 22, FIG. 3, in the regions of the reflector impinged upon by light passing through the slots 8. The matt regions of the reflector scatter the light impinging thereon so that it mingles with the overall spread of light.

The lamp described provides a direct beam of light when the diffuser sleeve 7 is in its fully retracted position. Light will still be obtained directly from the front end of the bulb 9 and this provides general illumination.

The rest of the light from the bulb 9 impinges directly on the reflector 5 which, as it is parabolic, and as the bulb filament is at the focal point of the parabola, forms a beam of light. The matt pattern on the reflector is unobservable in the beam of light.

By positioning the diffuser sleeve 7 in any position intermediate its forward position and its fully retracted position the proportion of light intensity of the beam to that of the diffused light can be selected as required.

When a miner is occupied with close work or walking along a mine gallery the diffuser sleeve 7 occupies the broken line position shown in FIG. 1, and when he wishes to direct a spot of light on to a position at the coal face he rotates the spindle 11 to move the diffuser sleeve 7 to the retracted position thereof.

FIGS. 1 and 2 also illustrate a pilot bulb 24 which is usually fitted to cap lamps but this pilot bulb forms no part of the present invention.

In the foregoing description the invention has been described as applied to a battery operated miner's cap lamp but it is to be understood that, if desired, a power source other than a battery may be used, and the lamp may be constructed as a hand-lamp for mining and other uses.

What is claimed is:

1. A portable electric lamp comprising:

a body including a lens, a lens holder, a reflector, and a bulb holder connectable through switching means with a source of electric power, a diffuser sleeve translucent to light co-axial with and surrounding the bulb holder, and drive means operatively engaged with the diffuser sleeve for effecting the axial movement thereof relative to the bulb holder between a retracted position at which light emanating from a bulb held in the bulb holder is focused into a spot beam by the reflector, and an extended position at which light emanating from the bulb is diffused or scattered by passage through said diffuser sleeve without reducing the overall intensity of the light passing through the lens.

2. A lamp according to claim 1, wherein the drive means comprises a toothed rack formed on the side of the diffuser sleeve and a manually rotatable spindle which extends through a side of the body and is provided with teeth meshing with the toothed rack.

3. A lamp according to claim 2, wherein the switch means comprises a first contact element located in the body for connection with a source of electric power and effecting electrical contact with the periphery of the spindle, a second contact element located in the body for connection with a source of electric power through the bulb holder, and a wiper rotatable with the spindle into and out of electrical contact with the second contact element.

4. A lamp according to claims 1, 2 or 3, wherein the diffuser sleeve has slots which extend lengthwise thereof, and the reflector is provided with a matt pattern in the regions thereof impinged by light passing through said slots in the light diffusing position of the diffuser sleeve.

5. A portable electric lamp comprising:

a body including a lens, a lens holder, a reflector, and a bulb holder connectable through switching means with a source of electric power, a diffuser sleeve co-axial with and surrounding the bulb holder, and drive means operatively engaged with the diffuser sleeve for effecting the axial movement thereof relative to the bulb holder between a retracted position at which light emanating from a bulb held in the bulb holder is focused into a spot beam by the reflector, and an extended light diffusing position at which light emanating from the bulb is diffused without reducing the overall intensity of the light passing through the lens.

6. A portable electric lamp as defined in claim 5, wherein the diffuser sleeve is provided with slots which extend lengthwise thereof and the reflector is provided with a matt pattern in the regions thereof impinged by light passing through said slots in the light diffusing position of the diffuser sleeve.

* * * * *